United States Patent [19]

Shimalla

[11] Patent Number: 4,588,630

[45] Date of Patent: May 13, 1986

[54] APERTURED FUSIBLE FABRICS

[75] Inventor: Charles J. Shimalla, Kendall Park, N.J.

[73] Assignee: Chicopee, New Brunswick, N.J.

[21] Appl. No.: 620,193

[22] Filed: Jun. 13, 1984

[51] Int. Cl.[4] ..... B32B 3/10

[52] U.S. Cl. ..... 428/131; 15/209 R; 156/155; 156/212; 156/219; 156/229; 156/290; 156/296; 428/171; 428/219; 428/296; 428/910

[58] Field of Search ..... 428/131, 171, 219, 910, 428/296; 156/155, 212, 219, 229, 290, 296; 15/209 R

[56] References Cited

U.S. PATENT DOCUMENTS

| | | | |
|---|---|---|---|
| 2,924,852 | 2/1960 | Michalko | 18/56 |
| 3,047,444 | 7/1962 | Harwood | 154/46 |
| 3,478,141 | 11/1969 | Dempsey et al. | 264/234 |
| 3,542,634 | 11/1970 | Such et al. | 428/296 |
| 3,917,785 | 11/1975 | Kalwaites | 264/108 |
| 3,920,874 | 11/1975 | Dempsey et al. | 428/296 |
| 3,949,127 | 4/1976 | Ostermeier et al. | 428/296 |
| 3,953,566 | 4/1976 | Gore | 264/288 |
| 4,005,169 | 1/1977 | Cumbers | 264/103 |
| 4,262,049 | 4/1981 | Kaspar | 428/131 |
| 4,265,954 | 5/1981 | Romanek | 428/131 |

*Primary Examiner*—James J. Bell
*Attorney, Agent, or Firm*—Leonard Kean

[57] ABSTRACT

An apertured non-woven fabric comprising a web of thermoplastic fibers is described. The fabric is formed with a multiplicity of fused patterned regions and adjacent substantially non-fused regions, there being apertures formed within a plurality of the fused patterned regions but not within the adjacent regions. The fabric is produced by heat embossing a non-woven web of thermoplastic fibers at a temperature above the softening point of the fibers whereby the regions of the web compressed by the projections of the embossing means become fused, and immediately thereafter drafting the embossed web so that apertures are formed in the fused patterned regions.

22 Claims, 4 Drawing Figures

APERTURED FUSIBLE FABRICS

This invention relates to apertured fusible fabrics formed with a multiplicity of fused patterned regions, the apertures being formed within the fused regions. This invention also relates to the method for producing said fabric.

BACKGROUND OF THE INVENTION

It is well known in the art to produce nonwoven fabrics comprising webs of thermoplastic fibers, by heat embossing said webs. The heat embossing is carried out by passing the fusible fibrous web through the nip between counterrotating heated rollers. One of the rollers comprises an embossing calender having raised projections or bosses, which have the effect of fusing corresponding regions of the web to provide a fused pattern in the web complementary to the pattern of the bosses on the calender. Normally the embossing calender is heated to a temperature above that of the softening point of the fusible fibers of the web. This is necessary so that the web travelling quickly through the nip attains the desired temperature. Normally, after the fibrous material is embossed it is taken up on a take-up roll, or batcher.

In accordance with the present invention, a web of fusible fibers is embossed at a temperature above the softening point thereof and apertures are formed in the fused patterned areas by immediately stretching, or drafting, the web preferably by increasing the batcher speed relative to the embossing speed.

PRIOR ART

Harwood, in U.S. Pat. No. 3,047,444 discloses a method of making a nonwoven fabric by printing spaced lines of stretch-strengthenable thermoplastic resin adhesive on to a nonwoven web and jointly stretching said web and said adhesive while said adhesive is soft and in a stretchable condition to an extent sufficient to increase the strength of said adhesive and to increase the porosity of the web. There is no disclosure in Harwood concerning the use of an embossing calender in order to produce patterned fused regions of the web produced by the projections of the embossing means and nor is there any disclosure in Harwood concerning the production of apertures in any fused regions of the web. Although Harwood discloses the stretching of his web, both in the machine direction and in the cross-direction, this is done primarily to affect the properties of the adhesive binder, to strengthen the web and to increase the general porosity of the web. No patterned apertures are produced by Harwood.

The Dempsey, et al. U.S. Pat. No. 3,478,141 discloses a process for embossing film-fibril sheets by exposing the sheets to heat and pressure between a pair of rolls, one of the rolls having a heat conductive surface of a specified number of bosses extending from the surface of the roll and the other roll having a resilient surface. Sufficient heat and pressure is provided by the rolls to form translucent windows directly beneath the bosses while at the same time lightly bonding the film-fibrils in the remaining areas of the sheet without fusing them. There is no disclosure in Dempsey, et al. concerning the subsequent drafting of the sheet in order to produce any apertures therein.

Cumbers, in U.S. Pat. No. 4,005,169 discloses a method for making a segmentally thermally bonded nonwoven fabric by compressing a fibrous web between heated members with different surface land patterns of isolated projections which overlap with each other to different extents in defined manner so that registration problems are avoided in manufacture and a complex surface texture is produced in the fabric. Cumbers does not disclose any drafting of his web in order to produce perforations therein.

Gore in U.S. Pat. No. 3,953,566 discloses a method for expanding paste formed products of a tetrafluoroethylene polymer to make them both porous and stronger, and heat treating them to increase their strength further while retaining a porous structure. No production of apertures by drafting the product is disclosed.

Kalwaites in U.S. Pat. No. 3,917,785 discloses a method of treating a layer of fibers to form a fibrous web having various areas of fiber concentration and opacity. The fiber layer is supported on an impermeable member and moving forces are applied to the supported layer. The forces move the fibers into areas of varying opacity and fiber concentration while maintaining substantially uniform density throughout these areas. No heat embossing between embossing rolls, nor drafting of the web thereafter is disclosed by Kalwaites.

Michalko in U.S. Pat. No. 2,924,852 discloses a method for shaping an initially heated thermoplastic fabric into a desired form under conditions permitting a distribution and balance of deformation effects of the fabric during the shaping operation. The shaping of the thermoplastic is accompanied by stretching or drawing the fabric into form by means of a suitable shaped mold and a shaping ring of convenient size. Michalko does not disclose the production of an apertured nonwoven fabric.

SUMMARY OF THE INVENTION

The present invention comprises an apertured nonwoven fabric comprising a web of thermoplastic fibers, said fabric having a multiplicity of fused patterned regions and adjacent substantially non-fused regions, there being apertures formed within a plurality of said fused patterned regions but not within said adjacent regions. Each aperture is surrounded by a perimeter of fused thermoplastic material. In the case of a fabric in which he fused patterned regions comprise both elongated and non-elongated regions, the elongated regions are in certain instances substantially free of apertures. The fabric is preferably produced by calender emboss bonding. The fibers of the adjacent regions of the fabric are preferably substantially oriented in one direction, the web having been drafted in said one direction so as to orient the fibers of the web and to increase the tensile strength thereof.

Any thermoplastic polymer which is suitable for the preparation of fibers may be used in accordance with the present invention. Suitable thermoplastic polymers are polyethylene, polypropylene, polypropylene/polyester blend, bicomponent sheath/core fibers, ethylene/vinyl acetate copolymer, nylon and polyester. Polypropylene fibers are preferably used in accordance with the present invention. Thermoplastic fiber blends with low concentrations of nonthermoplastic fibers such as rayon, may also be used, but hole clarity is reduced. Thermoplastic microfine fibers having a diameter of up to 10 microns (preferably melt blown polypropylene) may also be used in accordance with the present invention. In view of the greater temperature sensitivity of microfine fibers, lower temperatures are used when said fibers are heat embossed. The fabrics of the invention (other than those consisting of melt blown fibers) are produced by first forming a fibrous web comprising a loose array of suitable thermoplastic fibers, as by carding, air-laying, wet-laying or the like. Of course, when melt blown fibers are used, the web does not consist of a loose array of fibers, but is much more compact.

The present fabrics are prepared by heat embossing a nonwoven web of thermoplastic fibers with embossing means having projecting bosses, at a temperature above the softening point of said fibers, whereby the regions of the web compressed by the projections of the embossing means become fused, and immediately thereafter drafting said embossed web so as to create apertures in said fused regions. The embossing means preferably comprise a patterned calender, there being batcher means for taking up the fabric. The drafting is preferably carried out in the machine direction by increasing the batcher speed relative to the calender speed. To control the amount of drafting, pull rolls may be inserted between the calender and the batcher. However, the drafting of the web may also be carried out in the cross-direction by passing the fabric over a bow roll. The amount of draft, whether in the machine or in the cross-direction may range up to 100%, but a preferred draft (for non-melt blown fabrics) is about 25% when carried out in the machine direction. When the draft is carried out in the cross direction, the preferred range is between 10% and 30%.

DETAILED DESCRIPTION OF THE INVENTION

Figure 1:
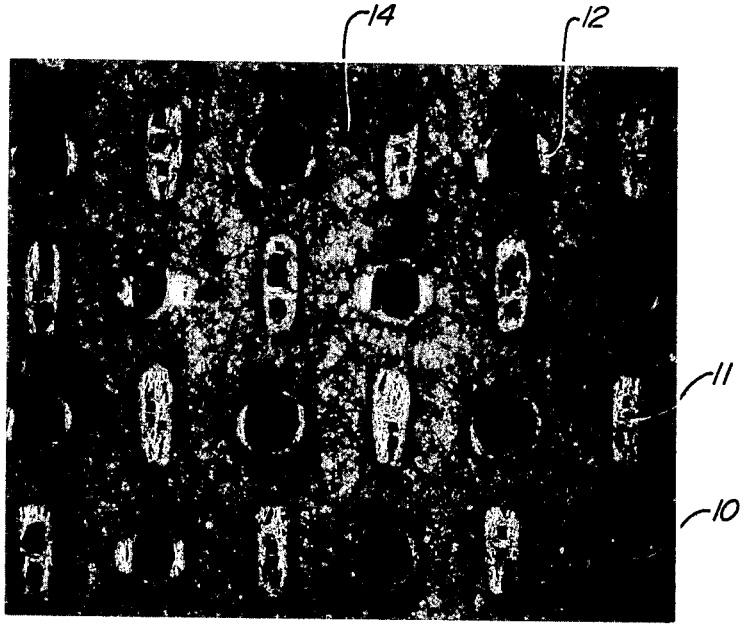
FIGS. 1, 2 and 3 are photographs of the fabric of Example 1 at 7.5X; 15X and 40X magnification respectively.

The present invention comprises a method of heat embossing a non-woven web of thermoplastic fibers at a temperature above the softening point of the fibers whereby the regions of the web compressed by the projections of the embossing means become fused, and immediately thereafter drafting the embossed web so that apertures are formed in the fused regions.

Preferably the fibers comprise polypropylene, although any thermoplastic polymer suitable for the preparation of fibers may be used. If a bicomponent fiber such as a high density polyethylene/polypropylene bicomponent fiber is used, then the embossing temperature must be maintained above the softening point of the high melting component of said bicomponent fiber. A preferred conjugate fiber employs high density polyethylene, that is, linear polyethylene that has a density of at least 0.94 and a Melt Index (M.I.) by ASTM D-1238(E) (190° C., 2160 gms) of greater than 1, preferably greater than about 10, and more preferably from 20 to about 50. Usually the conjugate fibers will be composed of about 40–60 weight percent, and preferably 45–55% weight, polyester, the remainder being polyethylene.

The fabrics of the invention are produced by first forming a fibrous web comprising a loose array of the thermoplastic fibers, as by carding, air-laying or the like (or by forming a more compact web of melt blown fibers). The exact weight of the fibrous web has not been found to be narrowly critical, although useful weights have been found to be within the range from about 0.8 to about 4 ounces per square yard (webs of melt blown material being in the lower range). This web is then conveyed to the nip of the embossing rollers.

A combination of heat and pressure is applied at the embossing nip (at a temperature above the softening point of the fibers of the web) whereby the regions of the web compressed by the projections of the embossing roller become fused. The method of the present invention encompasses using patterned embossing rollers generally known in the art. The patterned embossing rollers have raised patterned bosses which contact and compress the web as it passes through the nip of a pair of counter-rotating patterned embossing rollers. The web is thereafter taken up on a take-up or batcher roll. In accordance with one embodiment of the present invention, the batcher speed is increased relative to the embossing speed and this has the effect of creating apertures 10 within the fused regions of the web. (See FIGS. 1–3 of the drawings.) In accordance with this procedure, no apertures are formed within the non-fused regions 14 of the web. Each aperture will be surrounded by a perimeter 12 of fused thermoplastic material in which the original fibrous formation is no longer present. This can be clearly seen in FIGS. 2 and 3 of the drawings. The stretch, or draft of the web, immediately after passing through the embossing rollers may be up to 100%, depending upon the extent to which the web may have already been stretched prior to the time it was passed through the embossing rollers. A preferred draft is about 25%. This technique induces fiber orientation in the machine direction (see particularly FIG. 2 of the drawings) and this orientation increases the tensile strength of the resulting fabric.

In accordance with a further embodiment of the present invention cross-directional strength may be augmented by passing the web over at least one bow roll, directly after embossing. A bow roll is, as the name implies, shaped like a bow and the fabric tends to be stretched in the cross-direction as it passes over the bow roll. In accordance with the latter procedure, apertures are produced within the fused regions of the web, the size of the apertures varying to some extent, upon the percentage draft in the cross-direction. In utilizing a series of bow rolls, a draft of up to 50% may be achieved.

In accordance with a further embodiment of the present invention, the web is passed over a bow roll, as above described, the web being simultaneously drafted in the machine direction as well, by increasing the batcher speed relative to the embossing speed. In this manner, both the cross-directional and machine-directional strength of the web may be augmented. In addition, the apertures will be larger than would be the case if the web had been stretched in one direction only.

Before a web of bicomponent thermoplastic fibers is passed to the embossing rollers, the web may optionally be heated with heated air at a temperature sufficient to lightly fuse the sheaths to each other in order to strengthen the fabric in those areas which will subsequently not be compressed by the projections of the embossing roller.

The invention will be illustrated in greater detail by the following examples. It should be understood, however, that although the example may describe in particular detail some of the more specific features of the present invention, they are given primarily for purposes of illustration and the invention in its broader aspect is not to be construed as limited thereto.

EXAMPLE 1

A card web of polypropylene fibers (1.8 denier, 1½ inch staple) weighing 650 gr/yd$^2$ was passed through the nip of embossing rollers heated to 165° C. at a speed of 60 ft. per minute. The roll pressure was 500 lbs per lineal inch. The embossing pattern (known as Ramisch Roll pattern No. 3926) on the embossing rollers may be deduced, generally, from the embossed pattern on the fabric as illustrated in FIG. 1 of the drawings. However, it should be born in mind that the circular embossed areas shown in FIG. 1 were actually rectangular in shape and having their lengths in the cross direction of the fabric, prior to the drafting step. Also, the embossed areas which have their lengths in the machine direction, were also rectangular in shape, but shorter than those shown in FIG. 1, prior to the drafting step. The batcher speed was adjusted so as to take up the web at 75 ft. per minute so that the draft was 25%.

The polypropylene has a softening temperature of about 150° C. and a melting point of about 165° C.

Figure 2:
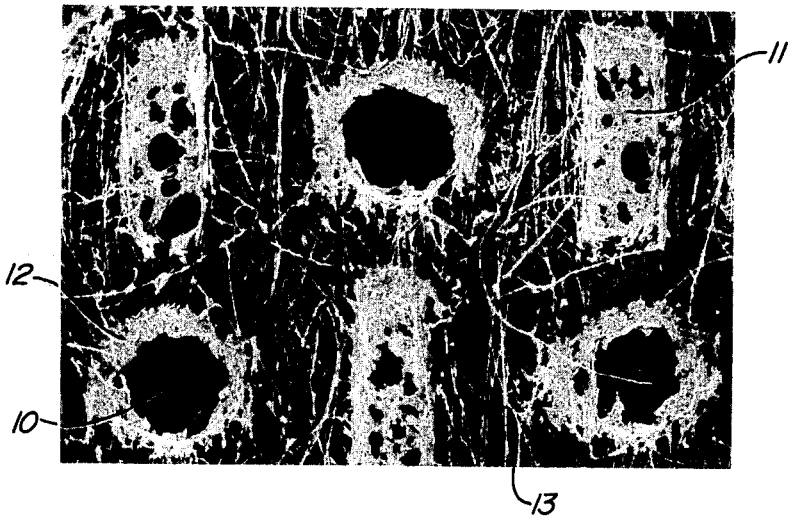
Figure 3:
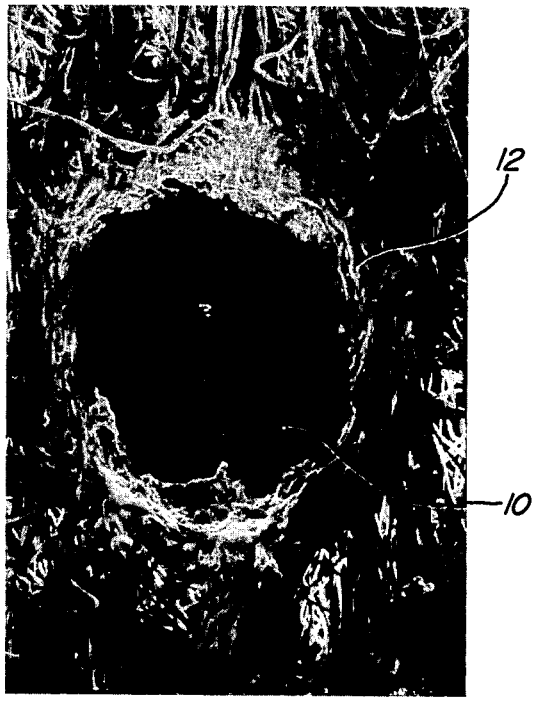

Apertures were formed in the fused patterned regions of the web. In addition, the fibers of the adjacent regions of the web were oriented in the machine-direction (which is from top to bottom as seen in FIGS. 1 to 3.

EXAMPLE 2

A card web of Hercules Herculon T-123 polypropylene fibers (3 denier 1.5 in staple) and weighing 600 gr/yd$^2$ was passed through the nip of embossing rollers in which the embossing roll was heated to 340° F. and the smooth roll was heated to 330° F. The roll pressure was 500 lbs per lineal inch. The embossing roll (Ramisch Pattern No. 3933) speed was set at 80 ft/minute and the chill-roll speed was set at 90 ft/minute so that the draft was 12½%. The polypropylene has a softening temperature of about 150° C. and a melting point of about 165° C.

Figure 4:
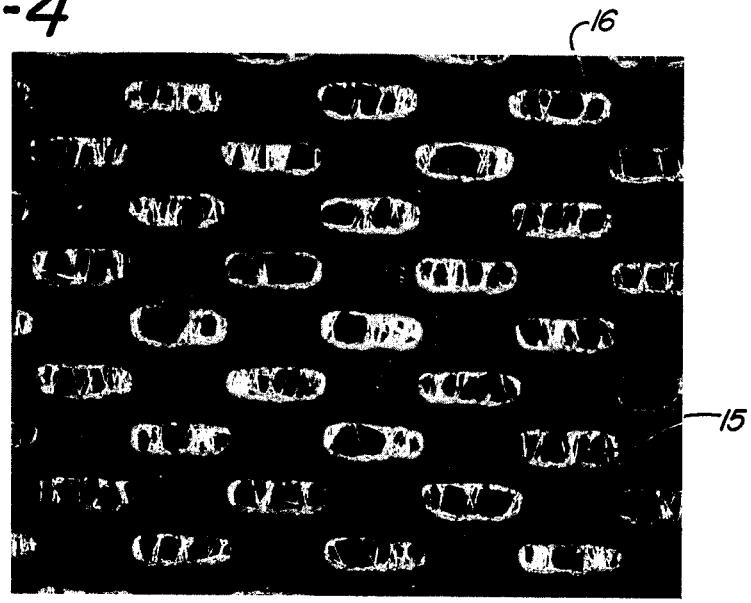
FIG. 4 is a photograph of the fabric of Example 2 at 7.5X magnification.

Uniform apertures were formed in the fused patterned regions of the web. Most of said apertures contained some fibers 15 extending across them in the machine direction (which is from top to bottom as seen in FIG. 4).

EXAMPLE 3

The polypropylene web of Example 1 is passed through the embossing rollers in the same manner as indicated in Example 1. However, in this instance, the batcher speed is the same as that of the embossing speed, but the web, immediately after leaving the embossing rollers is passed over a bow roll having a configuration such as to impart a draft of 10% in the cross-direction of the web. The resulting fabric is formed with apertures in the fused patterned regions thereof. No apertures are formed within the adjacent regions. However, in the latter adjacent regions of the web, the fibers are oriented in the cross-direction thereof.

EXAMPLE 4

A melt blown web of polypropylene fibers weighing 350 gr/yd$^2$ was passed through the nip of embossing rollers heated to 150° C. (the smooth roll being heated to 140° C.), at a speed of 30 feet per minute, the roll pressure being 500 lbs. per lineal inch. The embossing pattern was Ramisch Roll pattern No. 3926. The batcher speed was adjusted so as to take up the web at 40 feet per minute so that the draft was 33⅓%. Apertures, all of good clarity, were formed in the fused patterned regions of the web. The melt blown polypropylene has a softening temperature of about 120° C.

FIG. 2, which shows the fabric of the invention at 15X magnification illustrates the apertures which are formed in the fused patterned regions of the web. It will be noted that each aperture is surrounded by a perimeter of fused thermoplastic material. In view of the fact that the fabric of FIG. 2 was prepared in accordance with the process of Example 1 in which the fabric was drafted in the machine-direction, the fibers 13 are oriented in the machine-direction. Other comments concerning the fabric illustrated in FIG. 1 are as follows: (1) Rectangular embossed areas which have their lengths in the cross direction of the fabric yield good hole clarity and the holes are nearly circular due to the fabric extension and (2) rectangular embossed areas which have their lengths in the machine direction of the fabric yield a much lower degree of aperturing.

The fabric shown in FIG. 1 has embossed fused regions 11 and 12 corresponding to the pattern on the embossing roll used in Example 1. Similarly, the fabric shown in FIG. 4 has embossed, fused regions 16 corresponding to the pattern on the embossing roll used in Example 2.

The fabrics of the present invention are especially useful as industrial wipes. Where better hand properties are desirable the fabrics of the present invention may be prepared utilizing blends of polypropylene with rayon or polyester or bicomponent fibers such as high density polyethylene/polypropylene.

The fabrics of the invention, when prepared from melt blown fibers are especially useful for low stain, high opacity napkin facings. The degree of opacity is affected by the relative amount of embossing area of the embossing calender used. If embossing areas in the 5%–15% range are used, this provides good opacity, tear strength and softness.

Although present Example 3 illustrates the drafting of the web in the cross-direction utilizing a bow roll, nevertheless this cross-directional stretching may be accomplished by other means such as the mechanism shown in FIG. 27 of the Harwood U.S. Pat. No. 3,047,444. In the latter mechanism, the web is gripped along its opposite edges by suitable devices on diverging chains which act to stretch the web transversely and deliberately widen the web to the desired extent up to the take-up roll.

What is claimed is:

1. An apertured non-woven fabric comprising a web of thermoplastic fibers, said fabric having a multiplicity of fused patterned regions and adjacent substantially non-fused regions, there being apertures formed within a plurality of said fused patterned regions but not within said adjacent regions, each aperture being surrounded by a perimeter of fused thermoplastic material in which the original fibrous formation is no longer present.

2. An apertured non-woven fabric comprising a web of thermoplastic fibers, said fabric having a multiplicity of fused patterned regions and adjacent substantially non-fused regions, there being apertures formed within a plurality of said fused patterned regions but not within said adjacent regions, said web having been calender emboss-bonded, each aperture being surrounded by a perimeter of fused thermoplastic material in which the original fibrous formation is no longer present.

3. The fabric of claim 2 wherein said fibers are selected from the group consisting of polyethylene, polypropylene, polypropylene/rayon blend, polypropylene/polyester blend, bicomponent sheath/core fibers, ethylene/vinylacetate copolymer, nylon, and polyester.

4. The fabric of claim 3, wherein said fibers comprise polypropylene.

5. The fabric of claim 2, in which the fibers are melt blown.

6. The fabric of claim 2 in which said fused patterned regions comprise both elongated and non-elongated regions, and wherein said elongated regions are substantially free of apertures.

7. The fabric of claim 2, in which the majority of the fibers in said adjacent regions are substantially oriented in one direction.

8. The fabric of claim 3, said fabric weighing between 350 and 1750 gr/yd$^2$.

9. The fabric of claim 4, said fabric weighing about 650 gr/yd$^2$.

10. An industrial wipe, prepared from the fabric of claim 2.

11. A napkin facing, prepared from the fabric of claim 2, the fibers of said fabric having been initially melt blown.

12. A method of producing an apertured, non-woven fabric comprising a web of thermoplastic fibers, said fabric having a multiplicity of fused patterned regions and adjacent substantially non-fused regions, there being apertures formed within a plurality of said fused patterned regions but not within said adjacent regions, each aperture being surrounded by a perimeter of fused thermoplastic material in which the original fibrous formation is not longer present; said method comprising heat embossing a non-woven web of thermoplastic fibers with emossing means having projecting bosses, at a temperatur above the softening point of said fibers, whereby the regions of the web compressed by the projections of the embossing means become fused and immediately thereafter drafting said embossed web so as to create apertures in said fused regions.

13. A method of producing an apertured, non-woven fabric comprising a web of thermoplastic fibers said fabric having a multiplicity of fused patterned regions and adjacent substantially non-fused regions, there being apertures formed within a plurality of said fused patterned regions but not within said adjacent regions; each aperture being surrounded by a perimeter of fused thermoplastic material in which the original fibrous formation is no longer present; said method comprising heat embossing a non-woven web of thermoplastic fibers with embossing means having projecting bosses, at a temperature above the softening point of said fibers, whereby the regions of the web compressed by the projections of the embossing means become fused and immediately thereafter drafting said embossed web so as to create apertures in said fused regions; said embossing means comprising a patterned calender, there being batcher means for taking-up the fabric, said drafting being carried out in the machine direction by increasing said batcher speed relative to said calender speed.

14. A method of producing an apertured, non-woven fabric comprising a web of thermoplastic fibers said fabric having a multiplicity of fused patterned regions and adjacent substantially non-fused regions, there being apertures formed within a plurality of said fused patterned regions but not within said non-fused regions, each aperture being surrounded by a perimeter of fused thermoplastic material in which the original fibrous formation is no longer present, said method comprising heat embossing a non-woven web of thermoplastic fibers with embossing means having projecting bosses, at a temperature above the softening point of said fibers, whereby the regions of the web compressed by the projections of the embossing means become fused and immediately thereafter drafting said embossed web so as to create apertures in said fused regions, said embossing means comprising a patterned calender, said drafting being caried out in the cross direction by passing the fabric over one or more bow rolls.

15. The method of claim 13, in which the draft ranges between 10% and 100%.

16. The method of claim 14, in which the draft ranges between 10% and 30%.

17. The method of claim 12 wherein said fibers are selected from the group consisting of polyethylene, polypropylene, polypropylene/rayon blend, polypropylene/polyester blend, bicomponent sheath/core fibers, ethylene/vinylacetate copolymer, nylon, and polyester.

18. The method of claim 17 wherein said fibers comprise carded polypropylene.

19. The method of claim 15 in which the draft is about 25%.

20. The method of claim 17, wherein said fibers comprise bicomponent sheath/core fibers, and the embossing temperature is maintained above the softening point of the higher melting component of said bicomponent fibers.

21. The method of claim 17, wherein said fibers comprise melt blown polypropylene.

22. The method of claim 14, whereby the drafting is carried out in the cross direction while the web is simultaneously drafted in the machine direction as well, by increasing the batcher speed relative to the embossing speed.

* * * * *

UNITED STATES PATENT AND TRADEMARK OFFICE

CERTIFICATE OF CORRECTION

PATENT NO. : 4,588,630

DATED : May 13, 1986

INVENTOR(S) : Charles J. Shimalla

It is certified that error appears in the above—identified patent and that said Letters Patent is hereby corrected as shown below:

Claim 12, line 35 "not" should be -- no --.

Claim 12, line 37 "emossing " should be -- embossing --.

Claim 12, line 38 "temperatur" should be -- temperature --.

Claim 14, line 26 "caried" should be -- carried --.

Signed and Sealed this

*Twelfth* Day of *August 1986*

[SEAL]

*Attest:*

DONALD J. QUIGG

*Attesting Officer*

*Commissioner of Patents and Trademarks*